United States Patent [19]

Schaetti

[11] 4,264,644

[45] Apr. 28, 1981

[54] METHOD FOR COATING TEXTILE BASES WITH POWDERY SYNTHETIC MATERIAL

[75] Inventor: Josef Schaetti, Wallisellen, Switzerland

[73] Assignee: Schaetti & Co., Wallisellen, Switzerland

[21] Appl. No.: 29,776

[22] Filed: Apr. 13, 1979

[51] Int. Cl.[3] ..... B05D 1/28

[52] U.S. Cl. ..... 427/55; 118/202; 118/212; 118/246; 118/641; 427/195; 427/197; 427/428

[58] Field of Search ..... 427/194, 195, 197, 375, 427/428, 55; 118/202, 212, 246, 641

[56] References Cited

U.S. PATENT DOCUMENTS

| | | | |
|---|---|---|---|
| 2,355,919 | 8/1944 | Lipsius | 427/195 |
| 2,688,563 | 9/1954 | Kieffer | 427/195 |
| 2,884,348 | 4/1959 | Kulesza | 427/13 X |
| 3,085,548 | 4/1963 | Sheehan | 118/308 |
| 3,389,036 | 6/1968 | Rudolph | 427/428 X |
| 3,667,422 | 6/1972 | Saladin | 118/34 |
| 3,756,842 | 9/1973 | Meyers et al. | 427/428 X |
| 4,055,688 | 10/1977 | Caratsch | 427/195 |
| 4,096,016 | 6/1978 | Pohl | 427/197 X |
| 4,139,613 | 2/1979 | Hefele | 427/195 X |

FOREIGN PATENT DOCUMENTS 1561117 5/1968 Switzerland .

*Primary Examiner*—Shrive P. Beck

[57] ABSTRACT

A method for coating textile bases with a specified pattern of synthetic powder wherein the synthetic powder is applied to a water-cooled engraved roller and transferred to a textile base material while being under heat treatment for a substantial portion of the travel of the textile base along the application roller. Such heat treatment is provided by heat emitters external to the application roller thereby providing heating of the textile base and the powder through it.

10 Claims, 2 Drawing Figures

METHOD FOR COATING TEXTILE BASES WITH POWDERY SYNTHETIC MATERIAL

Figure 1:
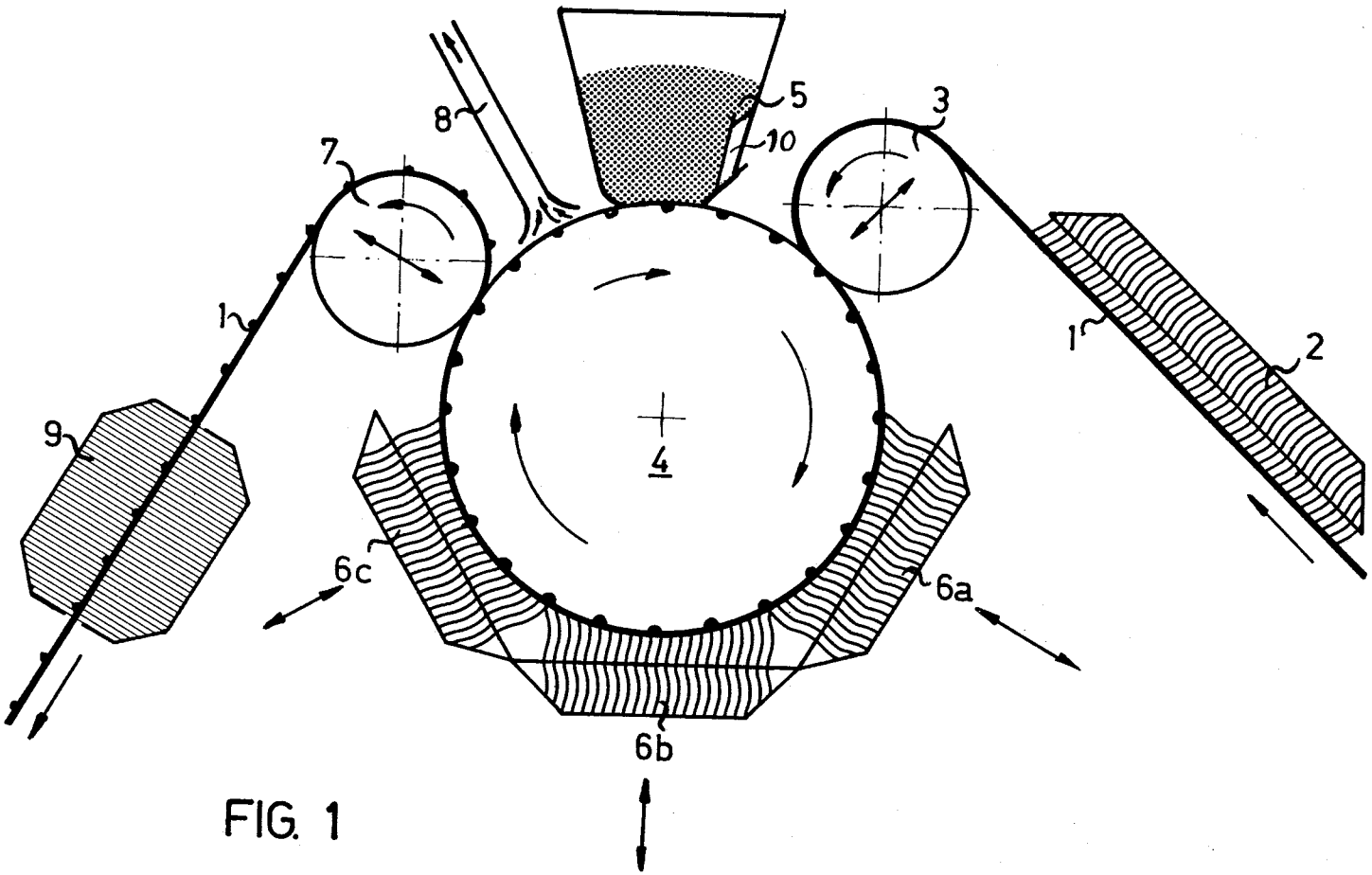

This invention relates to a method for coating textile bases according to a certain pattern with a synthetic powdery material where the powder is spread from a supply vessel onto a roller engraved conforming to the desired pattern and is then transferred onto the textile base under heat treatment.

Such a method is known, for instance, from the U.S. Pat. No. 3,085,548. The powder is distributed here from a supply vessel onto an engraved roller by means of a wiper. Finally, Swiss Patent CH-PS 561.117 also shows a method where a powder is spread onto an engraved roller—with oil-heated rollers pressing the textile sheet onto the water-cooled engraved roller in order to melt the powder onto a textile sheet in this manner. By means of infrared heating, which is also described in said patent, the applied material is supplementarily plasticized.

The last method mentioned permits speeds which are not obtained with methods that work with liquid material. However, the method raises thermal problems that are almost unsolvable. The heated pressure cylinders must, namely, be kept at a temperature of 260°-300° C. if moving is done at a speed of 30-40 m/min.

For many fabrics, which contain synthetic fibers, even a short time contact with such temperatures is impossible.

The heat required for the adherence of the material on the textile sheet is transferred from a roller to the textile sheet by heat conduction according to well known methods. The amount of heat transferred by conduction is dependent on the temperature difference and on the time of contact. If one wants to work with great speed, a correspondingly high temperature must be accepted because of the short time of contact.

The method according to Swiss Patent CH-PS No. 584.798 makes use twice of the method taught in Swiss Patent CH-PS No. 561.117. As can be seen from Swiss Patent CH-PS No. 535.121 which illustrates the device for executing the method as defined in CH-PS No. 584.798, synthetic powder is applied twice by means of a water-cooled engraved roller and an oil-heated auxiliary roller. The particles, which are applied conforming to the pattern, serve to combine several textile or textile-like materials into a sheet-shaped flat formation and finally to fuse with high frequency. The application of a pasty synthetic material is described in Swiss Patent CH-PS No. 433.181. Here the heat treatment is carried out by means of a cylinder, which is heated from the inside and which is heated during one revolution to 180° C. and cooled again to room temperature.

German Patent DE-OS No. 1.479.914 shows a lining machine for processing coated materials and describes the production method. The layered material is led around a heating roller in order to harden the applied material and is after-treated by means of a radiation emitter. Finally, in German Patent DE-OS No. 2.317.631 there is described a method for coating a textile sheet, for instance, a rug, with a liquid mass and to dry it. Here the textile surface is guided over a drum with a suction effect and is dried afterward.

In CH-PS No. 535.121 there is finally a teaching that, with simultaneous bilateral coating of a sheet-shaped flat textile formation, infrared radiation emitters can be present in the transfer zone. However, since for this purpose the two application rollers press directly against each other, the transfer zone is limited to the line of contact of the two application rollers. A heat treatment by infrared radiation emitters can thus be carried out only by the arrangement of the emitters inside the application rollers or by preheating of the flat formation. The first proposal has the disadvantage that the heat comes from the wrong side and that the synthetic powder particles remain adhering to the application roller whereas no adherance of the material to be applied on the flat textile formation takes place because of the bad heat conductance of the material to be applied.

The second proposal, however, demands a relatively high temperature of the flat textile formation and is therefore applicable only for a limited selection of textiles.

A satisfactory solution can only be obtained by a considerable enlargement of the transfer zone and a considerable lowering of the processing temperatures.

It is an object of the invention to provide a method where the fabric sheet is subjected to considerably lower temperatures and nevertheless permits high working speeds.

This object is achieved by the invention by means of a method which excells by the fact that the textile sheet, which is preheated first by heat radiation, is guided around the water-cooled engraved roller while being treated by heat such as infrared rays along a considerable part of the travel in one or more stages—with the powder being sintered on the base and finally being after-treated by heat radiation.

In contrast to the mentioned well known methods, the textile sheet never gets into contact with the surfaces which are so hot that they damage the material. The heat transfer takes place during the entire process by means of heat radiation. With the same working speed as that of the well known method according to CH-PS No. 561.117, greater amounts of heat can be brought to the textile sheet without damage at lower temperatures but over longer time periods.

Figure 2:
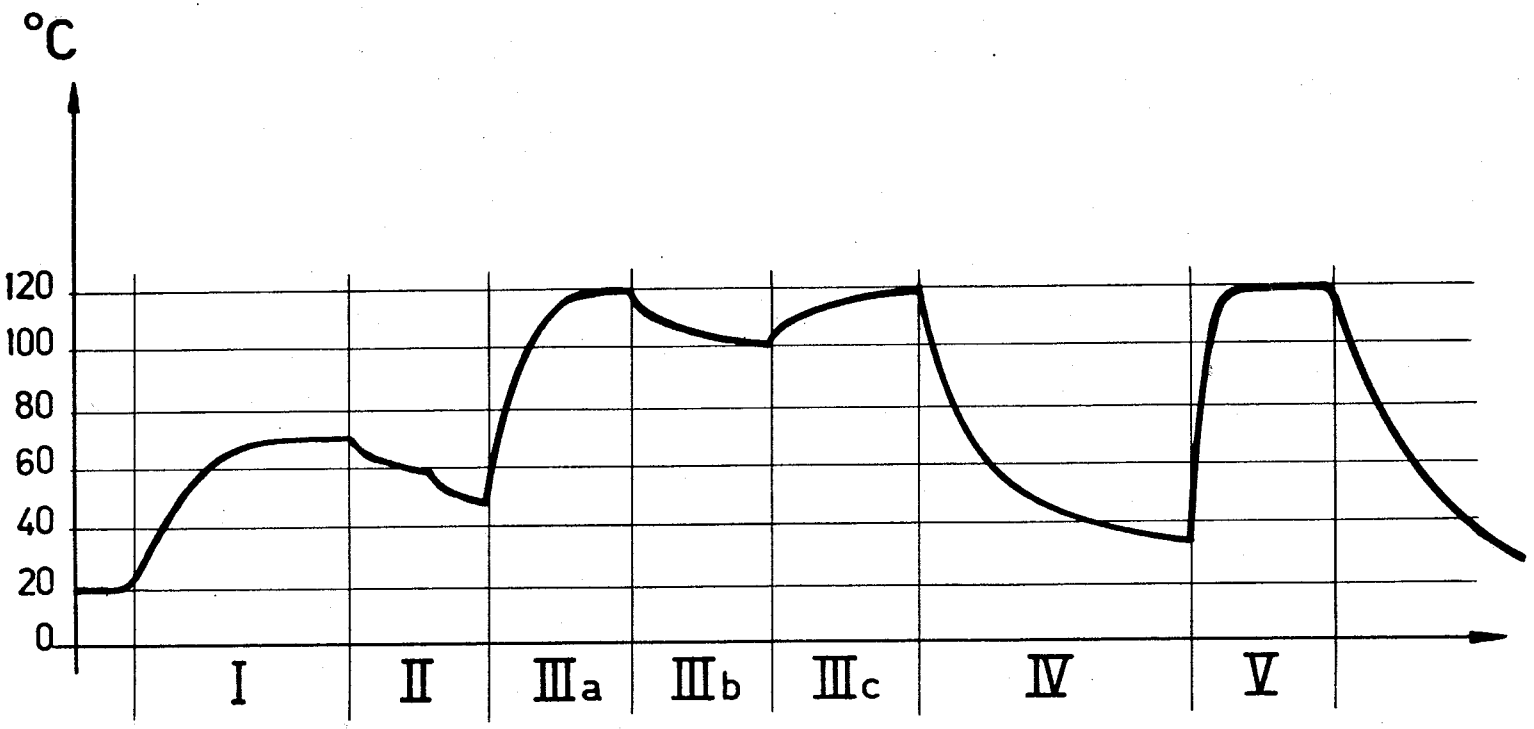

Preferred embodiments of the invention are shown in the drawing wherein:

FIG. 1 schematically shows a cross-sectional view of an apparatus for the process of this invention; and FIG. 2 graphically shows the temperature of a textile sheet during the process of this invention.

Referring to FIG. 1, textile base 1 in form of a textile sheet, which comes from a supply roll which is not shown, is preheated by heat radiation. For this purpose there is positioned either an infrared radiation emitter or a continuous microwave furnace shown as 2. The textile sheet preheated in this manner is pressed to the water-cooled engraved roller 4 by means of a non-heated guide roller or pressure roller 3.

Since the pressure roller 3 is not heated, it can be located very close to the powder application station with reservoir 5. The textile sheet, which is heated to about 70°-80° C., radiates very little heat and therefore does not cause any lump formation in the supply container of the powder application station. To reduce powder clogging occurring due to heat conduction which might take place from engraved roller 4 to powder in powder application station reservoir 5, it is preferred to provide cooling to the powder application station, such as by water cooling duct 10. The pressure roller 3 can be adjusted for pressure in the direction of the double arrow. Since, for the reasons described before, the pressure roller is arranged very close to the powder application station, the device can be operated at a high speed without the powder thereby falling out of the cup-shaped recesses called "calottes" in the trade language.

The engraved roller 4, which is known from different coating methods, is water-cooled. The measurement for the engraving of the roller is "mesh". Thus, for instance, 17 mesh means 17 calottes per inch.

The powder application station 5 is shown schematically. It includes in principle, a powder supply container, a powder feed device and one or several wipers. However, the application of powder is not an important aspect of the present invention.

The textile sheet 1 is so hot that the powder adheres on the textile sheet without entering into an intimate connection with it. It is true, the textile sheet cools off on the path from the preheating over the pressure roller 3 and the relatively short stretch from the contact with the water-cooled engraved roller to the first infrared radiation emitter *6a* of the first sinter station; however, its temperature remains nevertheless above the temperature of the water-cooled roller 4.

The sinter station 6 is subdivided into several stages, shown by the three stages *6a, 6b,* and *6c* in the drawing. These three stages are heaters, such as infrared radiation emitters, whose temperature can be regulated continuously. In the zone of the sinter station 6, a desired temperature course of 80°-200° C. can be obtained which is adjusted to the powder material and the textile sheet.

The temperature changes can be brought about either by energy control or by a change of the distance of the radiation emitters from the rollers. The double arrows indicate movement of the emitters for the latter.

At this first sinter station *6a–c* the textile fabric sheet and the applied powder are under heat treatment during a relatively long time. Consequently, one can work with much lower temperatures than before and achieve a better sintering of the powder and a more intimate connection with the material.

For the method it is of no importance whether the infrared radiation emitters *6a–c* are commercial flat plane emitters or special spherically curved emitters adjusted to the radius of the roller 4. The number of radiation emitters does not play any important part either; however, it is of advantage to work with several emitters.

After the first sinter station 6, the textile sheet 1 runs over another simple non-heated pressure roller 7, which can be adjusted for pressure in the direction of the double arrow, to another sinter station 9 in which after-treatment takes place. Here the coated side of the textile sheet can be irradiated by means of infrared radiation emitters as has been taught previously in connection with other methods.

So that the method is not impaired by residual particles of powder which have not combined with the other sintered particles, it is desirable to clean by suction the engraved roller 4 in the zone between the pressure roller 7 and the powder application station 5. For this purpose, a suction tube 8 is shown.

The heat treatment always presents a problem for today's textiles with the synthetic fibers available on the market. It is an advantage of the present invention to provide to the expert a process by means of which it is possible to coat any kind of textile with powder, for instances, cotton fabric, polyester fabric, synthetic wool fabric made of cellulose, and the like.

In FIG. 2 there is graphically shown, as an example, the temperature course of a textile sheet during the passage through a device as shown in FIG. 1. The individual phases are marked by Roman numbers. The textile sheet 1 coming from a supply roll has a temperature which corresponds to the room temperature, for instance, 20° C. In phase I, the sheet is preheated under the radiation emitter 2 to a temperature of approximately 70° C. During the period following phase II, the textile sheet is moved while cooling off. A bend in the temperature course of phase II occurs, especially if the sheet 1 is pressed to the cooled roller 4 by the pressure roller 3. Under the influence of the sinter station 6 there is phase III which is subdivided into phase IIIa, IIIb, IIIc corresponding to the infrared emitters or emitter fields. In the illustrated example the sheet is heated in the partial phase IIIa to a temperature of 120° C., subsequently kept at about 100° C. in the partial phase IIIb and finally heated again to 120° C. in the third partial phase IIIc. The fabric sheet 1, which is now coated with sintered material, cools off during the conveying (phase IV). The final reheating in phase V at sinter station 9 concludes the heat treatment at 120° C. and the fabric sheet cools off continuously to room temperature.

The new process works with radiation heat over a relatively large transfer zone. Synthetic powder is applied from a powder application station onto a textile sheet led around a water-cooled engraved roller and heated through the textile base with infrared radiation emitters during a considerable part of the travel. The irradiation can take place in several stages. The sintered-on powder is finally after-treated by heat irradiation. The method makes possible the powder-coating of heat-sensitive flat textile formations while permitting a high working speed.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a method for coating a textile base with powdery synthetic material by means of an engraved water-cooled application roll on which the powdery synthetic material is spread at a powder application station and transferred under heat treatment onto the textile base and is resintered, the improvement comprising; preheating said textile base by means of heat radiation, guiding said textile base around and in contact with the water-cooled engraved application roller while being heated by radiation heat emitters in one or several stages along a portion external to the circumference of the application roller with the powder being sintered on the base over a relatively large transfer zone during a substantial portion of travel of said application roller.

2. Method as defined in claim 1 characterized by the fact that the preheated textile base is pressed against the engraved application roll by means of an unheated guide roller as close as possible to the powder application station.

3. Method as defined in claim 1 characterized by the fact that the engraved application roll is cleaned of residual powder particles before the powder application station.

4. Method as defined in claim 1 characterized by the fact that the treated textile base is passed through another infrared radiation emitter station after leaving said application roller.

5. Method as defined in claim 1 characterized by said heat emitters comprising multiple infrared emitters.

6. Method as defined in claim 1 characterized by the fact that the powder application station reservoir is water-cooled to prevent clogging of the powder.

7. Method as defined in claim 1 characterized by said textile base in transfer zone being maintained at about 80° to about 200° C.

8. Method as defined in claim 7 characterized by said temperature of said textile base being maintained at about 80° to about 120° C.

9. Method as defined in claim 1 characterized by said transfer zone comprising about half of the circumference of said application roller.

10. Method as defined in claim 7 wherein said textile base is preheated to about 70° to 80° C.

* * * * *